United States Patent [19]

Boston, Jr.

[11] Patent Number: 4,822,117

[45] Date of Patent: Apr. 18, 1989

[54] REFRIGERATOR CASE/LINER INTERFACE AND RELATED COMPONENTS FOR AUTOMATED ASSEMBLY

[75] Inventor: Ray W. Boston, Jr., Louisville, Ky.

[73] Assignee: General Electric Company, Louisville, Ky.

[21] Appl. No.: 61,153

[22] Filed: Jun. 12, 1987

[51] Int. Cl.[4] ..... F25D 11/00

[52] U.S. Cl. ..... 312/214; 29/455 R; 312/257 R; 312/296

[58] Field of Search ..... 312/257 R, 257 SM, 214, 312/296, 116; 29/455 R, 460

[56] References Cited

U.S. PATENT DOCUMENTS

| | | | |
|---|---|---|---|
| 2,379,157 | 6/1945 | Jones | 312/296 X |
| 2,489,019 | 11/1949 | Drake | 312/214 X |
| 2,579,396 | 12/1951 | Philipp . | |
| 2,750,901 | 6/1956 | McClellan | 312/214 X |
| 2,899,256 | 8/1959 | Kelley | 312/296 |
| 2,958,210 | 11/1960 | Rill, Jr. | 312/214 X |
| 3,405,986 | 10/1968 | Cannon . | |
| 3,489,477 | 1/1970 | Harder, Jr. . | |
| 4,056,211 | 11/1977 | Zumwalt | 312/296 X |
| 4,114,065 | 9/1978 | Horvay . | |
| 4,330,310 | 5/1982 | Tate, Jr. et al. | 312/214 X |
| 4,348,068 | 9/1982 | Hawkins et al. . | |
| 4,558,503 | 12/1985 | Wilson | 312/214 X |
| 4,606,112 | 8/1986 | Jenkins et al. . | |
| 4,632,470 | 12/1986 | Jenkins et al. | 312/214 |

FOREIGN PATENT DOCUMENTS

| | | | |
|---|---|---|---|
| 1008105 | 10/1965 | United Kingdom | 312/214 |

*Primary Examiner*—Kenneth J. Dorner
*Assistant Examiner*—Thomas A. Rendos
*Attorney, Agent, or Firm*—Radford M. Reams; Frederick P. Weidner

[57] ABSTRACT

A refrigerator cabinet includes an outer housing having substantially parallel, spaced apart side walls connected by a top wall. A front face extends along the top and side walls and includes a peripheral groove open to the front of the cabinet. The groove has spaced apart, substantially flat lateral walls perpendicular to the front of the cabinet. A first cross-member extends between the side walls below the top wall to divide the cabinet into upper and lower sections. The first cross-member includes an upper groove open to the front of the cabinet and having spaced apart, substantially flat lateral walls perpendicular to the front of the cabinet. The upper groove connects with the peripheral groove at each side of the cabinet to form a first continuous channel encompassing the upper section. The first cross-member also includes a lower groove open to the front of the cabinet and having spaced apart, substantially flat lateral walls perpendicular to the front of the cabinet. The lower groove connects with the peripheral groove at each side of the cabinet. A second cross-member extends between the side walls below the first cross-member and includes a bottom groove connecting with the peripheral groove at each side of the cabinet. The bottom groove includes spaced apart, substantially flat lateral walls perpendicular to the front of the cabinet. The lower groove, bottom groove and connecting portions of the peripheral groove form a second continuous channel encompassing the lower section. A first elongated gasket is positioned in the first channel and includes a base portion removably engaging the lateral walls of the first channel and a seal portion projecting forwardly of the front face. A second elongated gasket is positioned in the second channel and includes a base portion removably engaging the lateral walls of the second channel and a seal portion projecting forwardly of the front face.

8 Claims, 4 Drawing Sheets

REFRIGERATOR CASE/LINER INTERFACE AND RELATED COMPONENTS FOR AUTOMATED ASSEMBLY

BACKGROUND OF THE INVENTION

Many modern day household refrigerators are divided into two compartments, typically with a freezer compartment on the top and a fresh food compartment on the bottom. A partition within the refrigerator separates the cabinet into these two compartments, each of which has its own door. It is desirable to incorporate a mullion across the cabinet in front of the partition and secured to the cabinet outer case or housing to provide a pleasing appearance. The separate access doors for the freezer and fresh food compartments normally are hingedly attached to the cabinet outer case. It is important for the proper fit of the doors that the width and rectangularity of the cabinet be properly maintained under normal or designed loads. Typically modern household refrigerators employ a sheet metal outer housing and an inner liner of metal or plastic with foam insulation, such as polyurethane, interposed therebetween. The foam material is introduced into the space between the housing and liner in a liquid/gas form and is then allowed to expand throughout the space and solidify by curing. As the foam expands it exerts a force which tends to cause the cabinet to bow. It is desirable to reinforce the cabinet, particularly at the front where the doors are to be hung, in order to assure that the door openings remain square during the foaming operation.

Once solid the foam inherently adheres to both the outer case and the inner liner and thus add rigidity to the cabinet structure. This has enabled manufacturers to reduce the thickness of the outer cabinet; however, in some instances the cabinet may tend to deflect due to uneven floors or the force placed on the cabinet by the weight of the doors. Such detection can cause a misalignment of one or both of the doors. Thus it is important to insure that the cabinet, particularly the front portion, remains square.

It has become a practice to incorporate a number of electrically operated devices in the doors of refrigerators for operation or viewing from the exterior of the refrigerator without opening the door. For example it is quite common to have through the door ice dispensers, ice crushers and water dispensers. Additionally it is becoming more common to have indicator panels and lights mounted on the door to be visible from the outside and inform users of various conditions of the refrigerator and possible malfunctions. All of these devices need electric power. In addition the same basic cabinet may be used for several different models which have many different combinations of door-mounted, electrically powered accessories. It is desirable to be able to install the wiring late in the manufacturing process, particularly after the foam insulation has been formed. This enables model differentiation to accomplished late in the manufacturing process and thus simplifies manufacturing.

The interior of a refrigerator is maintained at a temperature substantially lower than the exterior of the cabinet and heat transfer tends to cause the exterior of the cabinet around the doors to be sufficiently cool that moisture condenses on the metal wall. The cabinet appears to be "sweating". Mullion heaters often are placed within the cabinet just outside the edge of the doors, particularly the door to the freezer compartment, to prevent sweating. Such heaters normally are electrical resistance elements mounted within the outer housing and held in place by the foam insulation. Obviously with such a construction the heating element cannot be replaced. One approach to provide greater assurance of having an operative heater element is to embed two or more elements and have a changeable connection so that, if one becomes inoperative, the electrical connection can be changed to another to continue to provide the heating. This is inefficient from a cost standpoint as the multiple heaters are included in each refrigerator while, in many cases, only one element is ever used. Thus it is desirable to have a cabinet construction wherein the mullion heaters are easily replaced.

Accordingly, by the present invention means are provided to insure that the front of the refrigerator housing particularly the housing door openings remain square during production and operation of the refrigerator and that the cabinet has sufficient strength to support the doors.

Additionally a cabinet structure is provided which enables electrical wiring easily to be installed late in the manufacturing process for facilitating the use of various door mounted electrically operated accessories.

Additionally a refrigerator cabinet is provided including means for easy installation and replacement of mullion heaters.

SUMMARY OF THE INVENTION

In one form of the present invention there is provided a refrigerator cabinet comprising an outer housing having substantially parallel, spaced apart side walls and a connecting top wall. A front face extends along the top and side walls and includes a peripheral groove open to the front of the cabinet. The groove has spaced apart, substantially flat, lateral walls perpendicular to the front of the cabinet and a bottom wall.

A first cross-member extends between the side walls below the top wall to divide the cabinet into upper and lower sections and includes an upper groove open to the front of the cabinet. The upper groove has substantially flat lateral walls perpendicular to the front of the cabinet and a bottom wall. The upper groove connects with the peripheral groove at each side of the cabinet to form a first continuous channel encompassing the upper section of the cabinet. The first cross-member also includes a lower groove open to the front of the cabinet and having substantially flat lateral walls perpendicular to the front of the cabinet and a bottom wall. The lower groove connects with the peripheral groove at each side of the cabinet. A second cross-member extends between the side walls below the first cross-member and includes a bottom groove open to the front of the cabinet, the bottom groove has substantially flat lateral walls perpendicular to the front of the cabinet and a bottom wall. The bottom groove connects with the peripheral groove at each side of the cabinet so that the lower groove, the bottom groove and the connecting portions of the peripheral groove form a second continuous channel encompassing the lower section of the cabinet. A first elongated gasket is positioned in the first channel and includes a base portion removably engaging the lateral walls of the first channel and a seal portion projecting forwardly of the front face of the cabinet. A second elongated gasket is positioned in the second channel and includes a base portion removably engaging the lateral walls of the second channel and a seal portion projecting forwardly on the front face.

DESCRIPTION OF THE PREFERRED EMBODIMENTS

Figure 1:
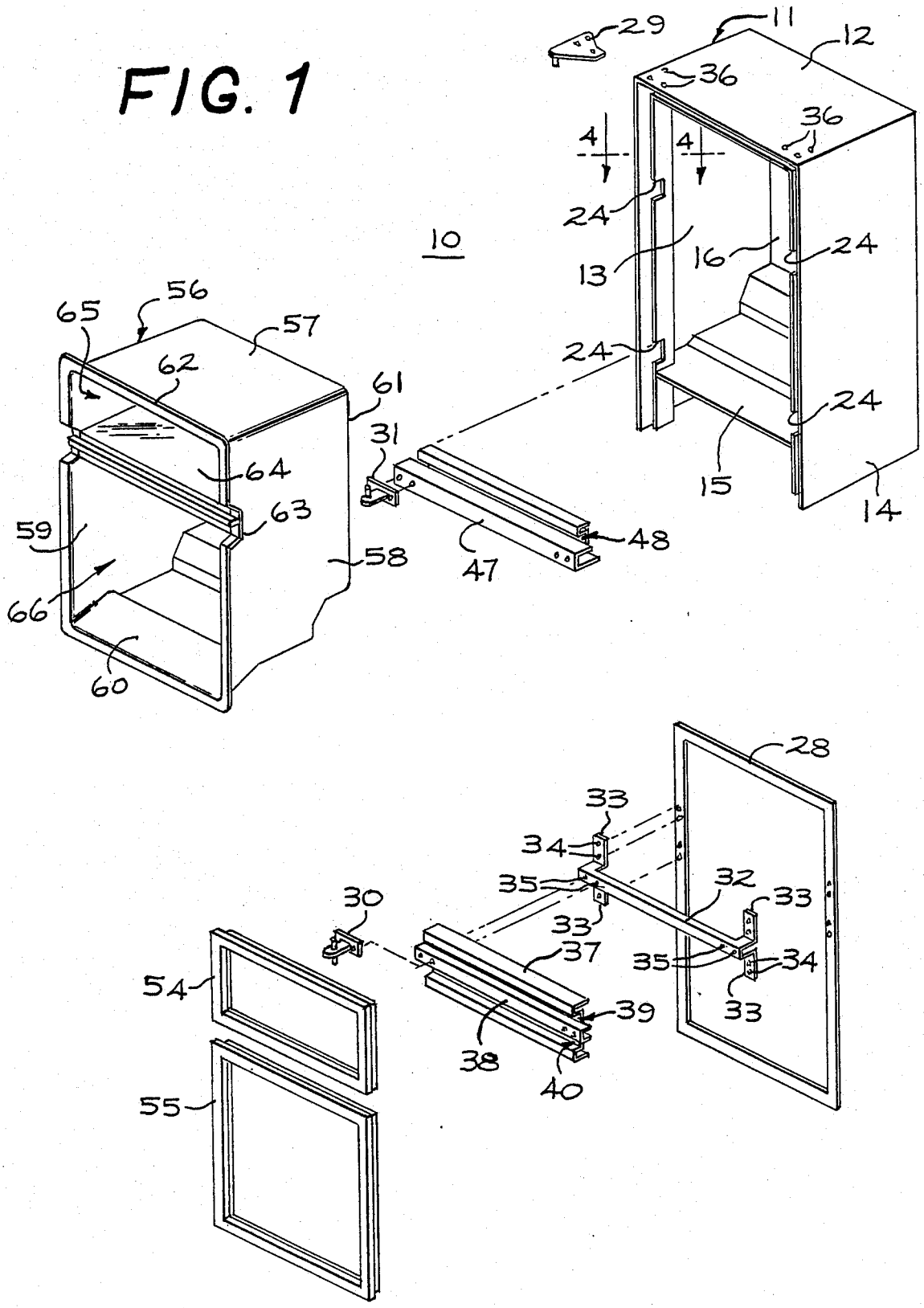
FIG. 1 is an exploded perspective view of a refrigerator cabinet according to one form of the present invention.
Figure 2:
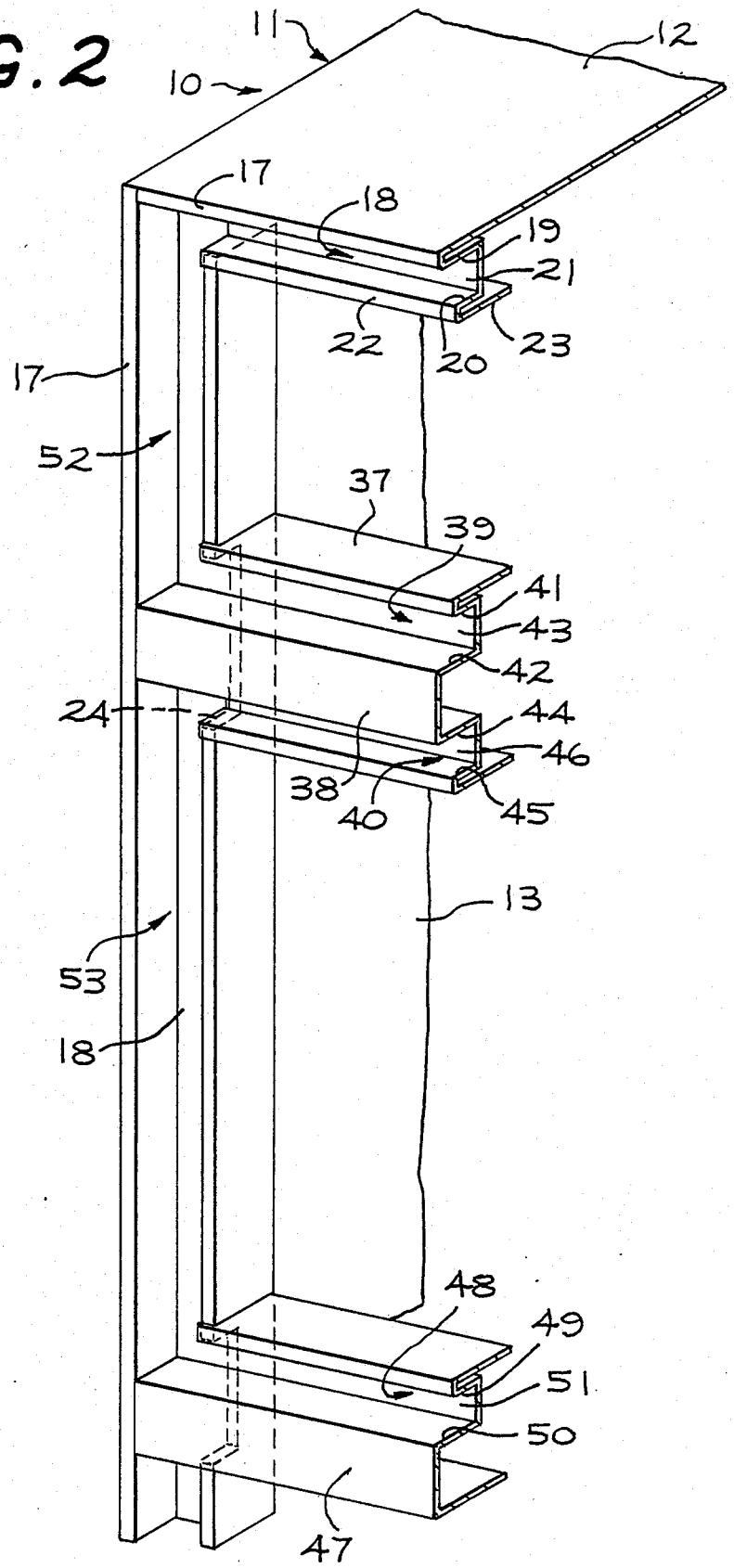
FIG. 2 is a fragmentary, perspective view illustrating details of the outer housing and cross-members of the refrigerator of FIG. 1.

Referring now to the drawings, particuarly to FIGS. 1 and 2, there is shown a refrigerator cabinet 10 incorporating one embodiment of the present invention. The cabinet includes an outer shell or housing 11 having a top wall 12 and spaced apart opposed side walls 13 and 14. The walls 12, 13 and 14 are formed from a single piece of material which is bent into a substantially inverted U-shape. Typically the shell 11 is formed from thin prepainted metal. The housing also includes a bottom wall 15 and a back wall 16. Since the bottom and back walls merely serve to confine the foam insulation and add greater structural rigidity they are formed separately from walls 12, 13 and 14. Walls 15 and 16 may be formed of materials which do not have the same painting and in fact may be even thinner than the material of walls 12, 13 and 14.

Figure 5:
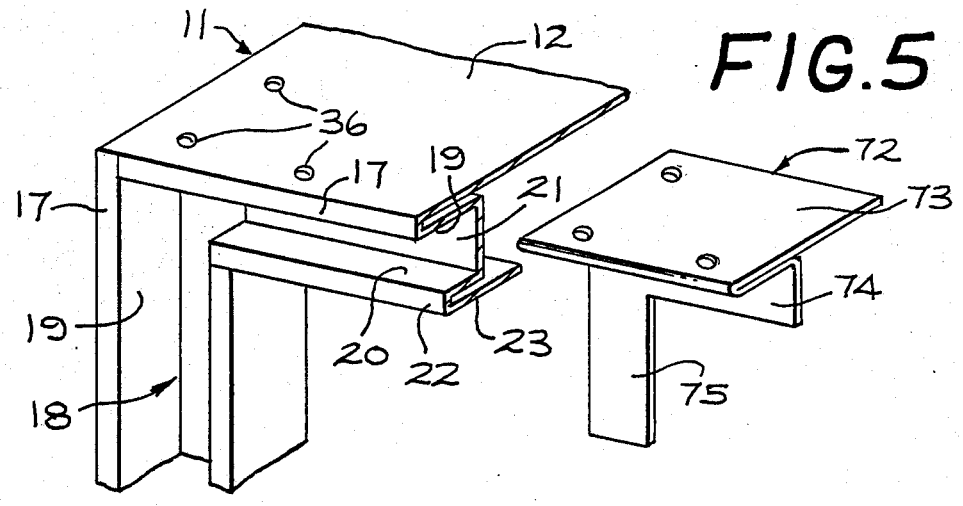
FIG. 5 is a fragmentary perspective view of an outer housing and one form of a corner brace.

As is best shown in FIGS. 2 and 5 the front portion of the housing 11 is bent to form a front face 17 projecting inwardly from and extending longitudinally along the front edge of the top wall 12 and side walls 13 and 14. Inwardly of the front face 17 the sheet metal is bent to form a groove 18 which extends longitudinally along the top and side walls. The groove 18 is formed by planar, spaced apart lateral walls 19 and 20, which are perpendicular to the front face 17, and a bottom wall 21. Inwardly of the groove 18 the sheet metal member is bent to form a ledge 22 and inwardly extending flange 23. Additionally the housing 11 is notched as shown at 24 to receive a brace and cross-members, as will be more fully described hereafter.

While the front face 17, groove 18, ledge 22 and flange 23 provide a added degree of structural strength and rigidity to the housing 11 it is often desirable, particularly in larger size refrigerators, to further enhance the strength and rigidity of the housing, particularly at the front. One means for doing this is a one-piece rectilinear frame 28 shown in FIG. 1. It is inserted into the groove 18 and structurally attached to the bottom wall 21.

In the illustrative embodiments access to the freezer compartment and fresh food compartment would be provided by separate doors, which have been omitted for the sake of simplicity as they do form part of the present invention. These doors are attached to the cabinet by mounts or hinges including, by way of example, upper hinge 29 intermediate hinge 30 and lower hinge 31. The freezer door is mounted on hinges 29 and 30 while the fresh food door is mounted on hinges 30 and 31. In order to provide additional strength and rigidity to the cabinet and a strong support for the middle hinge 30, there is provided a brace 32 having mounting feet 33, with a different mounting foot extending above and below each end of the brace. The brace 32 is mounted in alignment with the upper notches 24 the mounting feet 33 are positioned within the groove 18 against the frame 28. The mounting feet 33 are structurally attached to the frame 28 and bottom wall 21 by suitable means such as screws utilizing the screw holes shown at 34. As indicated by the screw holes 35 at each end of the brace 32 and the screw holes 36 at each front corner of the upper wall 12 the cabinet structure is adapted for the doors to be mounted selectively on either side of the housing.

A first or upper cross-member 37 extends between the side walls 13 and 14 in alignment with the brace 32. The cross-member 37 includes a central portion 38 which fits over the cross-member 32 and a pair of grooves 39 and 40. The groove upper 39 is formed with a pair of spaced apart, lateral walls 41 and 42 joined by a bottom wall 43 while the lower groove 40 is formed by a pair of spaced apart, lateral walls 44 and 45 and a bottom wall 46. The grooves 39 and 40 are open to the front of the cabinet and the lateral walls 41, 42, 44 and 45 are positioned perpendicular to the front of the cabinet and thus to the front face 17. A similar lower cross-member extends between the side walls 13 and 14 of the housing and fits into the lower notches 24. The lower cross member includes a bottom groove 48 formed by spaced apart, lateral walls 49 and 50 joined by a bottom wall 51. The groove 48 is open to the front of the housing and the walls 49 and 50 are positioned perpendicular to the front face 17. The upper and lower cross-members conveniently may be formed from the same thin, pre-painted material as housing 11.

The upper groove 39 intersects the peripheral groove 18 at each side wall 13 and 14 so that the upper groove 39 and the portion of the peripheral groove 18 in the upper part of the side walls 13 and 14 and the top wall 12 form a first channel 52 encircling the upper portion of the housing, which corresponds to the freezer compartment. The lateral walls and bottom walls of these grooves also provide lateral and bottom walls of the first channel. Similarly each of the lower channel 40 and the bottom channel 48 also intersects the peripheral groove 18 in each side wall 13 and 14. Thus the lower groove 40, bottom groove 48 and interconnecting portions of the lateral groove 18 form a second or lower channel encircling the lower portion of the housing, which corresponds to the fresh food compartment. The lateral and bottom walls of these grooves form the lateral and bottom walls of the second channel. A first gasket 54 is received in and extends longitudinally completely around the first channel 52. A second gasket 55 is received in and extends longitudinally completely around the second channel 53. Conveniently each of the gaskets 54 and 55 may be formed as a continuous generally rectangular member.

Figure 4:
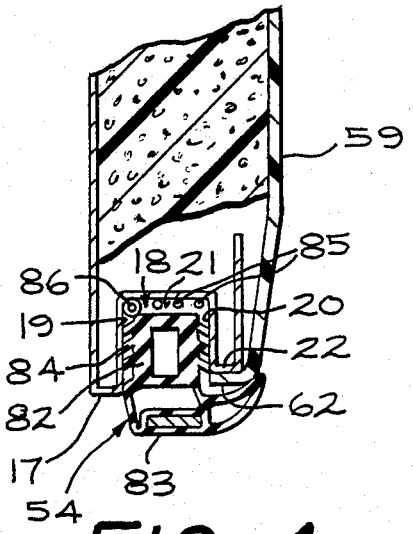
FIG. 4 is a fragmentary, cross-section view as seen along line 4—4 of FIG. 1 and illustrating a gasket and various electrical components.

An inner liner 56 conveniently may be formed of a plastic and takes the shape of an open front box having a top wall 57, side walls 58 and 59, a bottom wall 60 and a rear wall 61. An outwardly projecting flange 62 extends around the open front edge of the liner. The liner is mounted in the outer housing 11 with the flange 62 resting against the ledge 22 of the outer housing, as best seen in FIG. 4. To this end the ledge 62 is formed with a pair of indented portions 63 which fit in the upper notches 24 when the liner is mounted in the housing.

A dividing wall or mullion 64 is mounted in the liner 56 in alignment with the indented portions 63 and divides the liner, and thus the refrigerator, into an upper or freezer compartment 65 and a lower or fresh food compartment 66. It will be noted that, when the liner 56 is mounted in the housing 11, the mullion 64 is aligned with the brace 32 and upper cross-member 38.

Referring now particularly to FIG. 1, the refrigerator cabinet 10 as assembled generally as follows. First the outer housing 11 is formed by appropriately bending a continuous strip of prepainted steel which may have a thickness generally between 0.019 and 0.021 inches to form the top wall 12 and side walls 13 and 14 with the front face 17 groove 18, ledge 22 and flange 23. The separate bottom wall 15 is inserted into the housing 11 and the bottom cross-member is mounted in the lower notches 24 and overlaps bottom wall 15. Next the rectilinear frame 28 is mounted in the groove 18 in the housing 11 and the groove 48 and bottom cross-member 47. The frame is structurally attached to the housing 11 and cross member 47 by suitable means such as metal stitching, gluing, tack welding or so forth. Next the liner 56 is inserted into the housing 11 with the flange 62 resting on ledge 22 and mullion 64 is inserted into liner 56 in alignment with upper notches 24. Brace 32 then is positioned across the housing 11 with its feet 33 received in the portions of channel 18 adjacent both side walls 13 and 14 and positioned against the rectilinear reinforcing frame 28. The brace 32 is firmly attached to the reinforcing frame and housing 11 by suitable means such as screws which extend through openings in the feet 33 to engage the frame and housing. Next the upper cross-member 38 is positioned in the notches 24 so as to extend across the housing with its central portion 38 overlying the brace 32.

At this point foam insulation may be inserted into the space between the housing 11 and the liner 56 and allowed to expand to fully insulate the refrigerator. Prior to the foaming operation the rear wall 16 is placed into the housing. However, exactly when the rear wall 16 is placed in the housing depends upon whether any items are to be placed inside the housing and then held in place by the foam, as such items may have to be placed into the housing before the back is put on. Normally the gaskets 54 and 55 and the hinges, such as those shown at 29, 30 and 31, are attached to the housing after the foaming operation.

Figure 3:
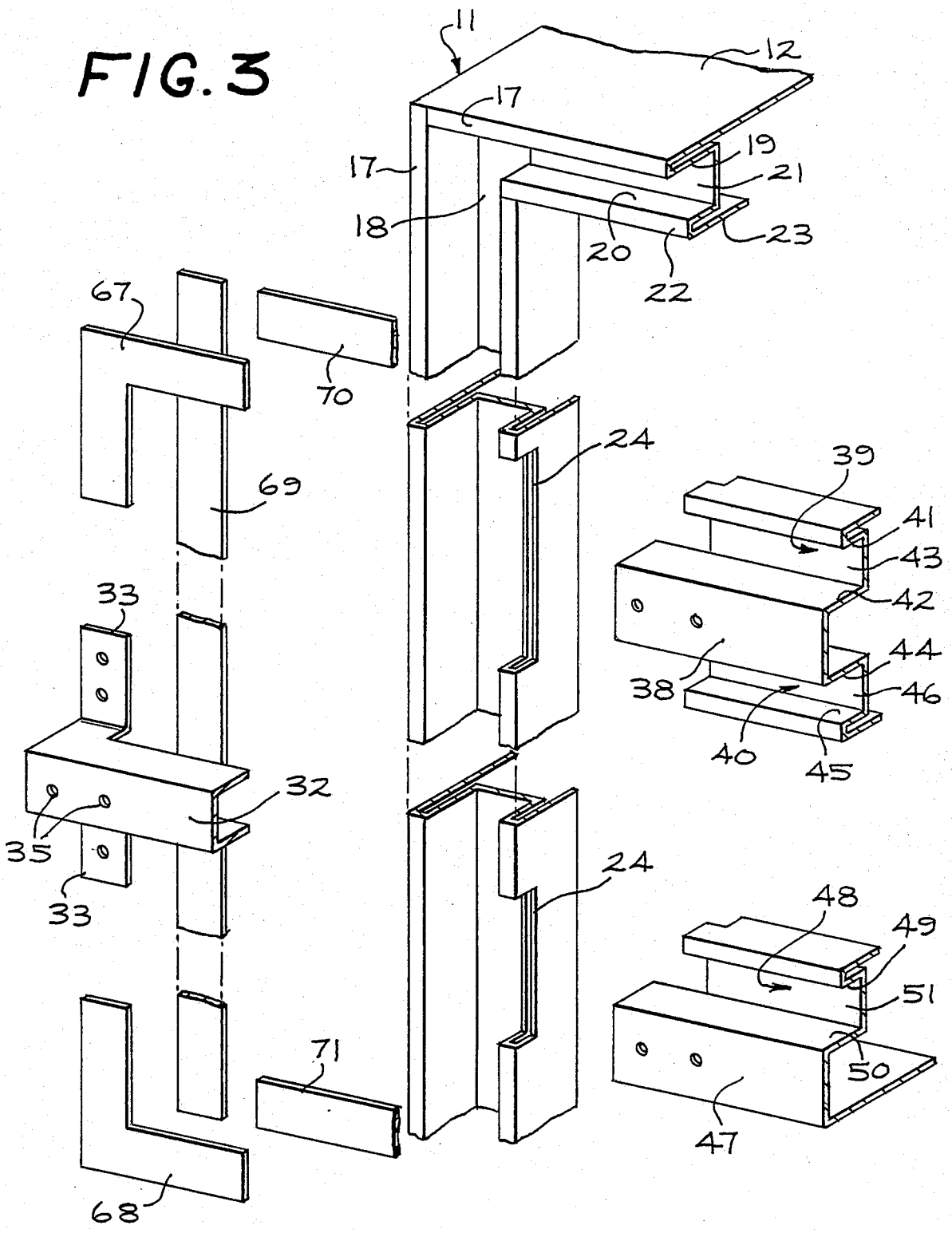
FIG. 3 is a fragmentary, exploded perspective view of a refrigerator cabinet illustrating various reinforcing members which may be utilized in accordance with the present invention.

Turning now to FIG. 3 there is illustrated other examples of bracing or reinforcing meabers which may be used in place of the frame 28. For example generally L-shaped corner brackets 67 and 68 may be inserted in the groove 18 at the four corners of the housing and attached to its bottom wall 21, that is where side walls 13 and 14 respectively meet the top wall 12 and where the lower cross member 47 meets the side walls 13 and 14 respectively. The corner brackets are structurally attached to the housing, normally the bottom wall 21 of groove 18, by suitable means such as metal stitching or welding. In many constructions, particuarly where the loading on the doors is not too great, L-shaped corner brackets will provide sufficient strengthening of the housing 11. In some cases, where more extensive reinforcing is desired, separate reinforcing bars such as those shown at 69, 70 and 71, are mounted in the peripheral groove 18 and the bottom groove 48 and extend longitudinally along substantially the entire length of these grooves. Again these reinforcing members would be structurally attached to the housing, normally by attachment by the bottom walls of the grooves.

Referring now to FIG. 5 there is shown yet another reinforcing member which may be employed to strengthen the upper corners of the housing and particularly the top wall at its front corners to better support upper hinge 29. To this end a reinforcing member 72 is formed with a plate 73, a flange 74 and a leg 75. The member 72 is mounted with the plate 73 positioned in the space between top wall 12 and lateral wall 19 of groove 18, with flange 74 against the bottom wall 21 of groove 18 adjacent to the top wall 12 and the leg 75 against the bottom wall 21 of the groove 18 adjacent to side wall 13. The reinforcing member then is attached to the housing 11 by some suitable means such as metal stitching or tack welding the flange 74 and leg 75 to the bottom wall 21 of groove 18. It will be understood that it is expeditious to mount reinforcing members 72 in the housing before the rear wall 16 is put on.

Figure 6:
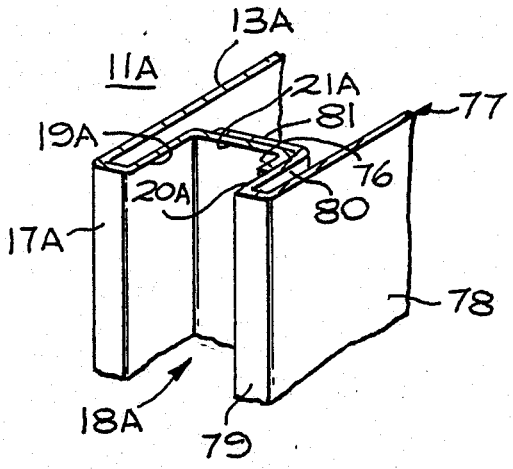
FIG. 6 is a fragmentary sectional view illustrating an alternate construction of the outer housing.

Even though the prepainted steel forming housing 11 is very thin it still is relatively expensive. FIG. 6 illustrates another construction of the housing in which the reinforcing member also forms a portion of the peripheral channel and thus reduces the amount of prepainted steel that is used. In this embodiment the housing 11A includes a side wall 13A having a front face 17A and a channel 18A. The prepainted steel is return bent to form one lateral wall 19A and the bottom wall 21A of the channel 18A. The distal edge of the sheet of prepainted steel is bent to provide a foot 76. The reinforcing member 77 conveniently may be an elongated strip of sheet steel which is bent to be U-shaped with one of its arms then further bent at a right angle so that, in cross-section, the reinforcing member 77 includes an arm 78, a base 79 and another arm 80 joined to a right angularly extending flange 81. The reinforcing member is positioned with its flange 81 against the bottom wall 21A and its arm 80 against the foot 76. The reinforcing member then in structurally attached to the bottom wall 21A by a suitable means such as metal stitching or spot welding. With this structure the foot 76 and arm 80 form the lateral wall 20A of the channel 18A.

Turning now to FIG. 4, the gasket 54 is shown in more detail, as are other features of the refrigerator construction. The gasket 54 includes a base portion 82 and a seal portion 83. The base portion 82 has a number of resilient FIGS. 84 extending outwardly from its sides. The gasket 54 is mounted in the upper channel by inserting the base portion 82 into the channel. The fingers 84 then releaseably engage the lateral walls 19 and 20 to hold the gasket in the channel. The seal portion 83 is positioned outside of the channel and thus forward of the front face 17 so as to engage the freezer compartment door and provide an appropriate seal. As can be seen the base portion 82 is dimensioned so that space is provided between the inner edge of the gasket and the bottom wall 21 of the channel 52. This space conveniently may be used to conduct electrical wiring such as that illustrated at 85 for providing power and control connections to electrically operated devices mounted in the door. Conveniently the wiring is conducted from the channel 52 to the door by leading it through either the upper hinge 29 or center hinge 30. Also a mullion heater 86 can be placed in the channel 18 and retained in place by means of the gasket 82. Thus, if the heater 86 becomes inoperative it may be accessed for replacement merely by removing the gasket 54. Once the mullion heater has been replaced, the gasket 54 easily may be reinserted into the channel 52. It will be understood that the lower gasket 55 conveniently may be of the same construction as the illustrated gasket 54 and that the lower channel also may be utilized for electrical wiring and a mullion heater if desired.

While particular embodiments of the present invention have been shown and described, it will be understood that other modifications falling within the spirit and scope of the invention may occur to those skilled in the art, and is an intended by the appended claims to cover all such modifications as fall within the spirit and scope of this invention.

What is claimed is:

1. A refrigerator cabinet comprising:

a casing including substantially parallel spaced apart side walls and a connecting top wall;

a front face extending along said top and side walls and including a peripheral groove open to the front of said cabinet, said groove having spaced apart lateral walls and a bottom wall, reinforcing means physically connected to said bottom wall and extending longitudinally of said groove;

an elongated brace extending between and physically connected to said casing side walls, said brace being spaced below said casing top wall to divide said casing into upper and lower sections;

said brace having feet physically attached to said bottom wall of said peripheral groove;

a first cross-member extending between said casing side walls and including a central portion overlying said brace; and a second cross-member extending between said casing side wall and spaced below said brace and first cross-members.

2. The refrigerator cabinet as set forth in claim 1 wherein said reinforcing means includes at least one elongated reinforcing member attached to the bottom wall of said peripheral groove and extending along the top and side walls of said cabinet.

3. The refrigerator cabinet as set forth in claim 1 wherein said reinforcing means includes corner brace means attached to said bottom wall of said peripheral groove adjacent the junction of said top and side walls.

4. A refrigerator cabinet as set forth in claim 1 wherein said reinforcing means includes an elongated strip having perpendicular first and second portions, one of said portions is attached to the base of said peripheral groove and the other of said portions extends along one of said lateral walls of said peripheral groove.

5. The refrigerator cabinet as set forth in claim 1 wherein:

said first cross-member includes an upper groove open to the front of said cabinet and having spaced apart lateral walls and a bottom wall; said upper groove connecting with said peripheral groove at each side of said cabinet to form with the upper portion of said peripheral groove a first continuous channel encompassing said upper section;

said first cross-member also includes a lower groove open to the front of said cabinet and having spaced apart lateral walls and a bottom wall; said lower groove connecting with said peripheral groove at each of said cabinet side walls;

said second cross-member includes a bottom groove open to the front of said cabinet and having spaced apart lateral walls and a bottom wall;

said lower groove, bottom groove and connecting portion of said peripheral groove form a second continuous channel encompassing said lower section;

a first elongated gasket extends throughout said first channel, said first gasket includes a base portion removably engaging the lateral walls of said first channel and a seal portion projecting forwardly of said front face; and a second elongated gasket extends throughout said second channel, said second gasket includes a base portion removably engaging the lateral walls of said second channel and a seal portion projecting forwardly of said front face.

6. The refrigerator cabinet as set forth in claim 5 wherein said bottom groove includes a bottom wall and said reinforcing means is formed as a rectilinear frame mounted against said bottom walls of said peripheral groove and said bottom groove.

7. The refrigerator cabinet as set forth in claim 5 wherein heater means is mounted in at least a selected one of said first and second channels between said bottom wall of said channel and the corresponding one of said gaskets.

8. The refrigerator cabinet as set forth in claim 5 wherein electrical wiring is mounted in at least a selected one of said first and second channels between said bottom wall of said channel and the corresponding one of said gaskets.

* * * * *